US006017279A

United States Patent [19]

Sumitomo

[11] Patent Number: 6,017,279

[45] Date of Patent: Jan. 25, 2000

[54] GOLF CLUB SHAFT

[75] Inventor: Norio Sumitomo, Akashi, Japan

[73] Assignee: Sumitomo Rubber Industries, Ltd., Kobe, Japan

[21] Appl. No.: 09/071,164

[22] Filed: May 4, 1998

[30] Foreign Application Priority Data

May 6, 1997 [JP] Japan ..... 9-132760

[51] Int. Cl.[7] ..... A63B 53/10

[52] U.S. Cl. ..... 473/316; 473/300; 473/319; 273/DIG. 7; 273/DIG. 23

[58] Field of Search ..... 473/317, 318, 473/319, 320, 321, 322, 300

[56] References Cited

U.S. PATENT DOCUMENTS

| | | | |
|---|---|---|---|
| 3,998,458 | 12/1976 | Inoue | 473/319 |
| 4,070,022 | 1/1978 | Braly | 473/289 |
| 4,455,022 | 6/1984 | Wright | 473/318 |
| 5,018,735 | 5/1991 | Meredith | 473/318 |
| 5,569,099 | 10/1996 | Jackson | 473/319 |
| 5,575,473 | 11/1996 | Turner | 473/298 |
| 5,626,529 | 5/1997 | Roy | 473/319 |
| 5,634,859 | 6/1997 | Nesbitt | 473/301 |
| 5,685,783 | 11/1997 | Akatsuka | 473/319 |
| 5,695,408 | 12/1997 | DeLaCruz | 473/300 |

*Primary Examiner*—Jeanette Chapman
*Assistant Examiner*—Stephen L. Blau
*Attorney, Agent, or Firm*—Armstrong, Westerman, Hattori, McLeland & Naughton

[57] ABSTRACT

A golf club shaft wherein an outer diameter of a base end of a grip side is arranged to be 16.5 mm to 26.0 mm, and weight of the shaft is arranged to be 30 g to 55 g. Low bend point rate determined by a formula {backward flex/(forward flex+backward flex)}×100 is set to be 55% to 61%.

3 Claims, 1 Drawing Sheet

GOLF CLUB SHAFT

BACKGROUND OF THE INVENTION

1. Field of the Invention

This invention relates to a golf club shaft.

2. Description of the Related Art

It is needless to say that enormous merits are obtained by reducing weight of a golf club, and weight reduction of the club has been mainly attained by reducing weight of the shaft. A steel shaft of more than 100 g has been superseded by a carbon shaft of less than 100 g, and recently, lightweight shafts of approximately 45 g have been produced. And in cases of carbon shafts, degree of designing freedom is high because materials of various elastic moduli can be used, and shafts of various characteristics such as a shaft of low bend point and a shaft of high bend point can be produced thereby.

In case of a lightweight shaft, however, adding to the limited amount of the material for the shaft, near an end portion (a portion connected with a golf club head) of the shaft which is required to be relatively strong has to be relatively reinforced more than other portions of the shaft, and the end portion becomes relatively harder than a base end portion of the shaft.

It is generally known that a golf ball hit by a golf club having a shaft of hard end portion does not gain much height. A golfer who uses lightweight clubs is powerless in many cases, and such a golfer often gets short flying distance of the golf ball because the golf ball does not gain sufficient height. Therefore, a lightweight shaft of low bend point is desired.

It is therefore an object of the present invention to provide a golf club shaft with which total weight of a golf club can be reduced and the golf club becomes a golf club of low bend point.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
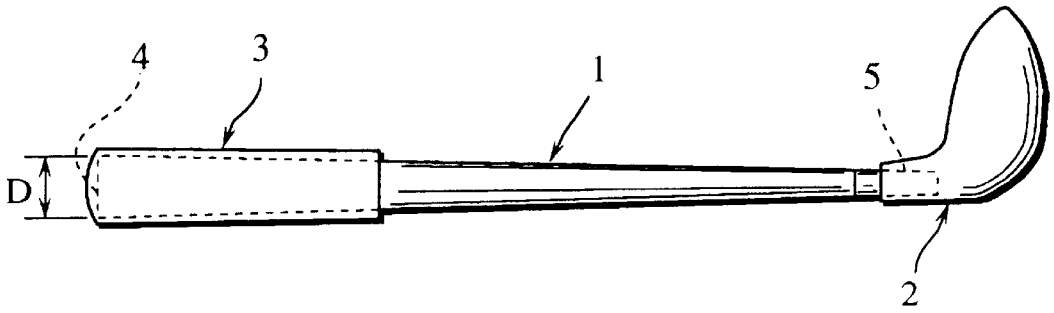
FIG. 1 is a side view of a golf club shaft according to the present invention.

FIG. 1 shows a golf club shaft according to the present invention. This shaft 1 is produced with conventional sheet winding method, filament winding method, etc., outer diameter of the shaft gradually diminishes from a base end side toward another end side to which a golf club head is fitted, a head 2 is attached to an end portion of the shaft 1, and a grip 3 is attached to a base end portion of the shaft 1.

The end portion of the shaft 1 (200 mm to 400 mm from an end of the head 2 side) is reinforced with a reinforcing material 5 of carbon fiber, of which elastic modulus is 5 ton/mm$^2$ to 15 ton/mm$^2$. And outer diameter D of a large diameter side, namely, of a base end 4 of the grip 3 side is arranged to be 16.5 mm to 26.0 mm, preferably 20.0 mm to 26.0 mm, and weight of the shaft 1 is arranged to be 30 g to 55 g. As reinforcing fiber of the reinforcing material 5, CF(carbon fiber), GF(glass fiber), etc. are used.

Then, low bend point rate(%) which is determined by a formula {backward flex/(forward flex+backward flex)}×100 is arranged to be 55% to 61%.

Figure 2:
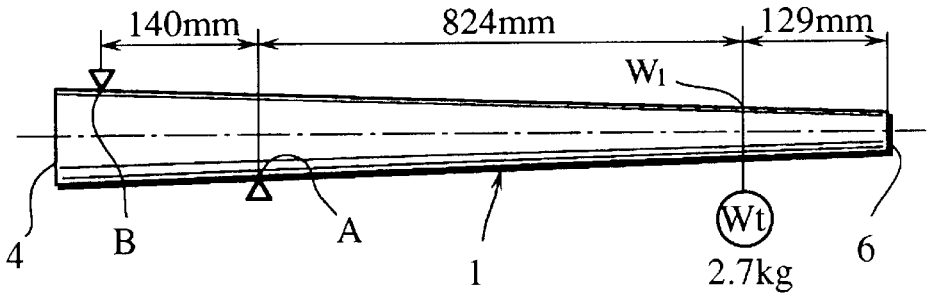
FIG. 2 is an explanatory view of a measuring method of forward flex.
Figure 3:
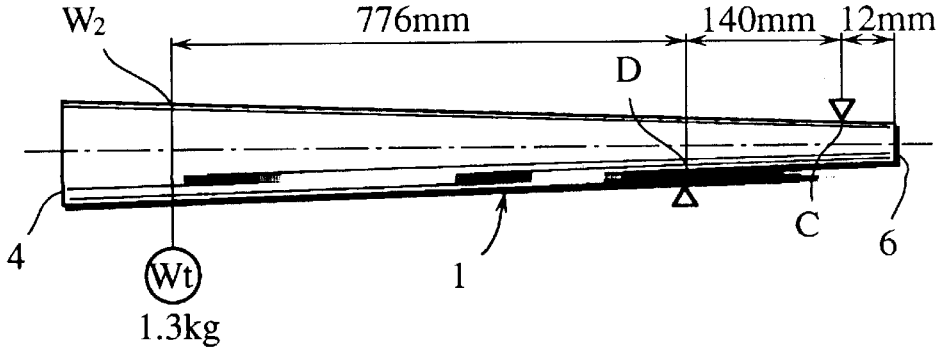
FIG. 3 is an explanatory view of a measuring method of backward flex.

The forward flex (normal flex) is, as shown in FIG. 2, a flex (flexure) measured with a condition in which a point of 129 mm from the end 6 of the head 2 side is a loading and measuring point $W_1$, a point of 824 mm from the loading and measuring point $W_1$ is a supporting point (fixing point) A, a point of 140 mm from the supporting point A is a supporting point (fixing point) B, and the loading and measuring point $W_1$ is loaded with a load of 2.7 kg. And the backward flex is, as shown in FIG. 3, a flex (flexure) measured with a condition in which a point of 12 mm from the end 6 is a supporting point (fixing point) C, a point of 140 mm from the supporting point C is a supporting point (fixing point) D, a point of 776 mm from the supporting point D is a loading and measuring point $W_2$, and the loading and measuring point $W_2$ is loaded with a load of 1.3 kg. Thus, the forward flex is expressed by the measurement of a vertical displacement by the load at $W_1$, and the backward flex is expressed by the measurement of a vertical displacement by the load at $W_2$.

The shaft 1 can be arranged to be of low bend point without considerable increase of the weight by enlarging the diameter of the base end 4 of the grip 3 side and the cone angle of the shaft 1. And, the larger the diameter of the base end becomes to the diameter of the end of the head 2 side, the easier production of the shaft 1 of the low bend point becomes, because flexural rigidity increases along with enlarging diameter of the shaft of the same material and the same wall thickness. Moreover, in the present invention, low elasticity carbon fiber, etc. of 5 ton/mm$^2$ to 15 ton/mm$^2$ can be used for reinforcing the end portion of the head 2 side, and the shaft of further low bend point is provided thereby. And furthermore, the wall thickness of the grip 3 can be reduced with enlarging the diameter of the base end 4 of the grip 3 side, weight reduction of the grip 3 becomes possible, and the total weight of a golf club can be reduced thereby.

As described above, the outer diameter of the base end 4 of the grip 3 side is arranged to be 16.5 mm to 26.0 mm, because if the outer diameter is less than 16.5 mm, the shaft does not become a shaft of appropriate low bend point, and if the outer diameter is over 26.0 mm, the thickness of the grip 3 becomes too thin to keep strength as a grip. The weight of the shaft is arranged to be 30 g to 55 g, because if the weight is less than 30 g, the shaft is excessively light, the production of the shaft is difficult, the strength of the shaft goes inferior, the end portion of the head 2 side of the shaft becomes more rigid than the base end portion of the shaft relatively because head connecting portion needs to be reinforced more than other portions, and if the weight is over 55 g, the shaft is not a light weight shaft. And the low bend point rate is limited to be 55% to 61%, because if the low bend point rate is less than 55%, the shaft is not a shaft of sufficient low bend point, and if the low bend point rate is over 61%, the shaft becomes a shaft of excessive low bend point.

Next, newly produced golf club shafts of which specifications are shown in Table 1 (examples 1 through 4) are compared with conventional golf club shafts (conventional products 1 through 4). In this case, the weight of the head attached to these shafts is arranged to be 190 g, and the club length is arranged to be 45.5 inches. In the column of the outer diameter of the grip after insertion of Table 1, the left side of the column shows an outer diameter of a back end portion of the grip, and the right side of the column shows an outer diameter at a point of 200 mm from a back end of the grip.

TABLE 1

| | Shaft Outer Diameter of the Base End (mm) | Shaft Weight (g) | Low Bend Point Rate of the Shaft (%) | Grip Weight (g) | Grip Density (g/cm$^3$) | Grip Outer Diameter After Inserting Shaft (m) Base End | Grip Outer Diameter After Inserting Shaft (m) 20 mm Point from the Base End | Elastic Modulus of Carbon Fiber for Reinforcing the End of the Head Side (t/mm$^2$) | Club Total Weight (g) |
|---|---|---|---|---|---|---|---|---|---|
| Conventional Product 1 | 16.0 | 45 | 47.3 | 42 | 1.05 | 28.0 | 19.3 | 24 | 282 |
| Conventional Product 2 | 16.0 | 45 | 50.5 | 42 | 1.05 | 28.0 | 19.3 | 24 | 282 |
| Conventional Product 3 | 16.0 | 47 | 53.7 | 40 | 1.05 | 28.0 | 19.3 | 5 | 282 |
| Conventional Product 4 | 20.0 | 49 | 52.8 | 28 | 1.05 | 28.0 | 19.3 | 24 | 272 |
| Example 1 of the Present Invention | 16.5 | 47 | 55.2 | 37 | 1.05 | 28.0 | 19.3 | 15 | 279 |
| Example 2 of the Present Invention | 26.0 | 55 | 58.0 | 18 | 1.05 | 28.0 | 19.3 | 24 | 268 |
| Example 3 of the Present Invention | 16.5 | 47 | 56.5 | 37 | 1.05 | 28.0 | 19.3 | 15 | 279 |
| Example 4 of the Present Invention | 26.0 | 55 | 61.0 | 18 | 1.05 | 28.0 | 19.3 | 5 | 268 |

In comparison with the conventional products 1 through 4 (these are relatively of low bend point as conventional products) having low bend point rate of less than 54% (the highest one is 53.7%), all of examples 1 through 4 of the present invention have low bend point rate over 55% (the lowest one is 55.2%). In the conventional product 3, the low bend point rate is only 53.7%, although CF (carbon fiber) of elastic modulus 5 ton/mm$^2$ is used for reinforcing the end.

In the conventional product 4, although the outer diameter of the base end of the grip side is arranged to be 20.0 mm, the low bend point rate is 52.8% because CF of elastic modulus 24 ton/mm$^2$ is used for reinforcing the end of the head side. And, in the example 1, the low bend point rate is 55.2% for relatively low elastic CF of elastic modulus 15 ton/mm$^2$ used for reinforcing the end of the head side, and in the example 2, the low bend point rate is 58.0% because the outer diameter of the base end of the grip side is enlarged to be 26.0 mm, despite CF of elastic modulus 24 ton/mm$^2$ used for reinforcing the end of the head side. In the examples 2 and 4, although enlarging the outer diameter of the end of the grip side has to be accompanied by a little increase of the shaft weight, club total weight is lighter than that of conventional products because the grip weight can be reduced. The grip weight is reduced because the outer diameter of the grip attached to the shaft is kept constant. And the outer diameter of the grip after the insertion is set to be a general value for a golf club for men. As described above, the larger the shaft diameter becomes, the thinner the thickness of the grip becomes, and the grip weight is reduced thereby.

Therefore, according to the present invention, the shaft of low bend point is provided and the reduction of total weight of the golf club can be achieved. That is to say, as in this shaft of the present invention, the larger the diameter of the base end becomes to the diameter of the end of the head side, the more low bend the shaft becomes, and the shaft of low bend point can be easily made, because flexural rigidity increases with enlarging diameter of the shaft of the same material and the same wall thickness. Moreover, the wall thickness of the grip 3 can be reduced because the outer diameter D of the base end 4 of the grip 3 side is large, weight reduction of the grip 3 becomes possible, and the reduction of the total weight of the golf club can be achieved thereby. And, in actual production, there is another merit that this golf club shaft can be easily produced by conventional sheet winding method and filament winding method with only a configurative modification of a mandrel.

Especially, according to a golf club shaft of which end portion of the head side is reinforced with the reinforcing material 5 of carbon fiber having elastic modulus of 5 ton/mm$^2$ to 15 ton/mm$^2$, a golf club shaft of further low bend point can be provided.

While preferred embodiments of the present invention have been described in this specification, it is to be understood that the invention is illustrative and not restrictive, because various changes are possible within the spirit and indispensable features.

What is claimed is:

1. A golf club shaft comprising an outer diameter of a base end of a grip side of 16.5 mm to 26.0 mm, weight of the shaft of 30 g to 55 g, and low bend point rate which is determined by a formula {backward flex/(forward flex+backward flex)}×100 of 55% to 61%, wherein the forward flex is a vertical displacement at a first loading and measuring point $W_1$ measured with a condition in which a point of 129 mm from the end of the head side is the first loading and measuring point $W_1$, a point of 824 mm from the loading and measuring point $W_1$, is a supporting point A, where the shaft is supported upward;

a point of 140 mm from the supporting point A is a supporting point B, where the shaft is supported downward and the first loading and measuring point $W_1$ is loaded downward with a load of 2.7 kg, and backward flex is a vertical displacement at a second loading and measuring point $W_2$ measured with a condition in which a point of 12 mm from the end of the head side is a supporting point C, where the shaft is supported downward, a point of 140 mm from the supporting point C is a supporting point D, where the shaft is supported upward, a point of 776 mm from the supporting point D is a loading and measuring point $W_2$ and the second loading and measuring point $W_2$ is loaded downward with a load of 1.3 kg.

2. The golf club shaft as set forth in claim 1, wherein an end portion of 200 mm to 400 mm from an end of a golf club head side is reinforced with a reinforcing material of carbon fiber having elastic modulus of 5 ton/mm$^2$ to 15 ton/mm$^2$.

3. The golf shaft as set forth in claim 1, further comprising a grip, wherein an outer diameter of the grip after insertion is 28 mm.

* * * * *